United States Patent [19]

Kinuno et al.

[11] Patent Number: 4,855,645

[45] Date of Patent: Aug. 8, 1989

[54] MAGNETRON FOR MICROWAVE OVEN

[75] Inventors: Masanori Kinuno, Yokohama; Hisao Saito, Fujisawa; Akira Kousaka; Toshio Kawaguchi, both of Yokohama, all of Japan

[73] Assignee: Kabushiki Kaisha Toshiba, Kawasaki, Japan

[21] Appl. No.: 105,047

[22] Filed: Oct. 6, 1987

[30] Foreign Application Priority Data

Oct. 6, 1986 [JP] Japan ..... 61-236221
Oct. 27, 1986 [JP] Japan ..... 61-253835

[51] Int. Cl.[4] ..... H01J 25/50

[52] U.S. Cl. ..... 315/39.71; 315/39.51; 315/39.75; 313/153

[58] Field of Search ..... 315/39.51, 39.53, 39.71, 315/39.75; 313/151, 152, 153, 49

[56] References Cited

U.S. PATENT DOCUMENTS 4,338,545 7/1982 Koinuma et al. ..... 315/39.51
4,426,601 1/1984 Tsuzurahara ..... 315/39.51

FOREIGN PATENT DOCUMENTS 51-56172 5/1976 Japan .
51-58859 5/1976 Japan .
53-38966 4/1978 Japan .
57-10060 2/1982 Japan .
57-18672 4/1982 Japan .
58-55560 12/1983 Japan .
61-10987 8/1986 Japan .

*Primary Examiner*—Leo H. Boudreau
*Assistant Examiner*—Michael Razavi
*Attorney, Agent, or Firm*—Cushman, Darby & Cushman

[57] ABSTRACT

In a magnetron, anode vanes are radially arranged in an anode cylinder and fixed to the inner surface of the anode cylinder. A cathode is arranged along a tube axis in the anode cylinder. Pole pieces of dish like shape are fixed to openings of the anode cylinder and the anode cylinder is hermetically sealed by cylindrical chambers. Permanent magnet rings are arranged around the cylindrical chambers, respectively, and are magnetically coupled by a yoke. Each of the pole pieces has a flange section, a flat inner disk section and a coupling section extending from the flange section to flat inner disk section. The outer diameter of pole piece is larger than 160% the diameter of an envelope defined by inner ends of the anode vanes. A envelope space contacting the inner ends of the anode vanes has a predetermined magnetic field intensity distribution that is produced by a magnetic flux supplied from the pole pieces and has a difference of not more than 15% along the tube axis.

4 Claims, 15 Drawing Sheets

MAGNETRON FOR MICROWAVE OVEN

BACKGROUND OF THE INVENTION

The present invention relates to a magnetron for a microwave oven and, more particularly, to a magnetron in which a magnetic field distribution in its interaction space is improved to suppress generation of a relatively low-frequency line conducted noise component (hereinafter called line noise or line noise component).

In a magnetron, it is known that a distribution of a magnetic field applied to an interaction space greatly influences oscillation of the magnetron. Ideally, the magnetic field distribution in the interaction space should be such that magnetic flux is perfectly parallel to the tube axis and has a uniform density over the entire region of the interaction space. However, in a magnetron for a microwave oven, in particular, a cathode for emitting electrons is arranged on the tube axis, and a support member for supporting the cathode extends along the tube axis. Therefore, a through hole having a predetermined inner diameter must be formed at the center of a pole piece for guiding magnetic flux into the interaction space. In addition, an inexpensive and compact permanent magnet must be arranged outside a tube. Furthermore, in order to prevent electrons from flying from a portion between an end shield and corners at anode vane inner ends toward the pole pieces, magnetic flux is preferably generated obliquely with respect to the tube axis at the end portion of the interaction space. Due to the above limitations, it is difficult to obtain a uniform magnetic field distribution perfectly parallel to the tube axis over the entire range of the interaction space.

Conventionally, Japanese Patent Disclosure No. 53-38966 discloses a magnetron having a structure wherein a magnetic field is uniform or is set to be stronger at the side of the anode vanes over a range of the interaction space extending from a cathode surface to the anode vane inner end faces to improve stability of oscillation. Japanese Patent Disclosure Nos. 51-56172 and 51-58859 describes, a magnetron having pole pieces with an improved shape to obtain a parallel magnetic field distribution in the interaction space. However, in a magnetron of this type, a permanent magnet is incorporated in a tube, and pole pieces, each having substantially the same diameter as that of the magnet, are coupled to the magnet surface. Therefore, due to the structural difference, the above proposals cannot be directly applied to a magnetron having a basic structure in which a ring-shaped ferrite magnet is arranged outside the tube and magnetic flux are guided to the interaction space through funnel-shaped pole pieces.

A conventional magnetron for a normal microwave oven has a magnetic flux distribution as shown in FIG. 1 near the interaction space. Magnetic flux B are generated to be substantially parallel to tube axis Z near the center in the axial direction of interaction space S extending from substantially cylindrical electron radiation surface K to vane inner end faces A. In contrast to this, in regions Se where end seals 26 and 27 oppose the vane inner end faces, magnetic flux B are generated obliquely with respect to tube axis Z, i.e., toward center Z=0.

The conventional magnetron has a distribution shown in FIG. 2. FIG. 2 shows a relative magnetic field intensity in an interaction space between cathode surface K and anode inner end face A when an average magnetic field intensity from cathode surface K to anode inner end face A at the central portion (Z=0) of interaction space S is given by 100%, and distances along the tube axis from the central portion to respective points (Z=0, Z=±1 mm, Z=±2 mm, Z=±3 mm, Z=±4 mm, and Z=±5 mm) are used as variables. As can be seen from FIG. 2, in the conventional magnetron, curves having distances Z as variables intersect each other, and intensities are substantially equal to each other regardless of distances Z in intermediate region P in the radial direction of the interaction space. Thus, the most uniform magnetic intensity distribution can be generated in intermediate region P extending along the tube axis in the interaction space. However, a large variation in magnetic field intensity occurs along the axial direction at and around anode inner end face A. The width of an anode vane, i.e., size La of an inner end face along the axial direction is normally 9.5 mm, and a magnetic field intensity difference in the axial direction around anode inner end face A reaches about 22% within this range.

As shown in FIG. 3, line noise corresponding to frequency components of 30 to 400 MHz exists at an input side through a cathode support member, and a line noise level for the low-frequency component of 30 to 150 MHz is high. For a component in a 100-MHz range (corresponding to a range of 80 to 120 MHz, and including a maximum level), the line noise level reaches about 42 dBμV (decibel microvolts).

The reason for the high line noise level is that, since axial magnetic field intensities at a vane central portion and two end corners have a large difference near the anode vane inner end face in the interaction space, rotational speeds of electrons locally vary. The frequency of a high-frequency electric field induced in a resonance cavity, including the anode vanes by the electron cloud, varies depending on the position in the interaction space in accordance with the magnetic field intensity. A frequency component corresponding to a difference in frequencies is leaked to the input side as a line noise component of a relatively low frequency. This can be regarded as a cross modulation-like phenomenon. This noise level tends to be increased when a magnetron output section and a load are strongly coupled.

A strong demand has recently arisen for a compact magnetron, in particular, a small height in the axial direction in order to make a microwave oven compact. If a distance between pole pieces is simply reduced to effect magnetic flux generated from a magnet, an electric field coupling is increased between the pole pieces and strap rings. As a result, reverse emission of electrons toward a cathode is increased, and a temperature of the cathode is increased. In the worst case, thermal runaway may occur. When an axial length of the anode vane is decreased in order to keep a given distance between the pole pieces and the strap rings, load stability may be degraded. For example, it was demonstrated that if the axial length of the vane is decreased from 9.5 mm to 8 mm, the load stability of the magnetron is degraded to a peak value of 1.3 A.

Note that if a cathode introduction portion, i.e., an input stem portion is shortened, e.g., if the stem length is decreased from 20.4 mm to 10 mm, reverse emission of electrons increases a great deal, and the temperature of the cathode increases. In the worst case, the cathode may partially melt. It was demonstrated that reverse emission of electrons is increased in proportion to a decrease in stem length.

SUMMARY OF THE INVENTION

It is an object of the present invention to provide a magnetron for a microwave oven, that can improve a magnetic field intensity distribution in an axial direction in an interaction space, in particular, near an anode vane inner end face to effectively suppress component line noise component of a relatively low frequency.

It is another object of the present invention to provide a compact and reliable magnetron for a microwave oven that has a high magnetic efficiency, and can suppress unnecessary radiation such as line noise.

According to the present invention, there is provided a magnetron comprising an anode cylinder having a tube axis, and having openings and an inner surface, a cathode, arranged along said tube axis, for emitting electrons from its surface, a cathode support member, extending along the tube axis, for supplying a current to said cathode, a pair of end shields, electrically coupled to said cathode support member, for supporting said cathode arranged therebetween, a plurality of anode vanes, radially arranged around said cathode, inner ends of said plurality of anode vanes facing said cathode to have a gap therebetween so as to define an interaction space between themselves and said cathode and resonance cavities with said anode cylinder, outer ends of said plurality of anode vanes being fixed to said inner surface of said anode cylinder, said inner ends defining an envelope having a predetermined diameter, a pair of large- and small-diameter strap rings for alternately connecting said anode vanes, a pair of pole pieces having a substantially dish shape, for supplying magnetic flux to said interaction space, each of which is constituted by a flange portion mounted on the corresponding opening of said anode cylinder, a flat disk section, arranged adjacent to said anode vanes and having a predetermined outer diameter and a through hole which has a diameter substantially equal to that of the envelope and in which said end shield is arranged, and a coupling section for coupling said flange and disk portions, and which are arranged opposite to each other, wherein the predetermined outer diameter is larger than 160% the diameter of the envelope, and the magnetic flux have a magnetic component directed along the tube axis in an envelope space, which has magnetic field intensity difference of not more than 15% along said tube axis, a pair of permanent magnets for generating the magnetic flux supplied to said pair of pole pieces, an antenna lead, electrically coupled to the resonance cavity, for guiding microwaves generated in the resonance cavity, and a yoke for magnetically coupling said pair of permanent magnets.

According to the present invention, there is also provided a magnetron comprising an anode cylinder having a tube axis, and having openings and an inner surface, a cathode, arranged along said tube axis, for emitting electrons from its surface, a cathode support member extending along the tube axis, for supplying a current to said cathode, a pair of end shield, electrically coupled to said support member, for supporting said cathode arranged therebetween, a plurality of anode vanes, radially arranged around said cathode, inner ends of said plurality of anode vanes facing said cathode to have a gap therebetween so as to define an interaction space between themselves and said cathode and resonance cavities with said anode cylinder, outer ends of said plurality of anode vanes being fixed to said inner surface of said anode cylinder, said inner ends defining an envelope having a predetermined diameter, a pair of large- and small-diameter strap rings for alternately connecting said anode vanes, a pair of pole pieces having a substantially dish shape, for supplying magnetic flux to said interaction space, each of which is constituted by a flange portion mounted on the corresponding opening of said anode cylinder, a flat disk section, arranged adjacent to said anode vanes and having a predetermined outer diameter and a through hole which has a diameter substantially equal to that of the envelope and in which end shield is arranged, and a coupling section for coupling said flange and disk portions, said flat disk section having a surface facing said anode vanes and a projection having a predetermined diameter and formed to have a substantially circular shape, and which are arranged opposite to each other, wherein the predetermined diameter is larger than 150% the diameter of the envelope, and the magnetic flux and has a magnetic component directed along the tube axis in an envelope space, which has a magnetic field intensity difference of not more than 15% along said tube axis, a pair of permanent magnets for generating the magnetic flux supplied to said pair of pole pieces, an antenna lead, electrically coupled to the resonance cavity, for guiding microwaves generated in the resonance cavity, and a yoke for magnetically coupling said pair of permanent magnets.

DETAILED DESCRIPTION OF THE PREFERRED EMBODIMENTS

Figure 4:
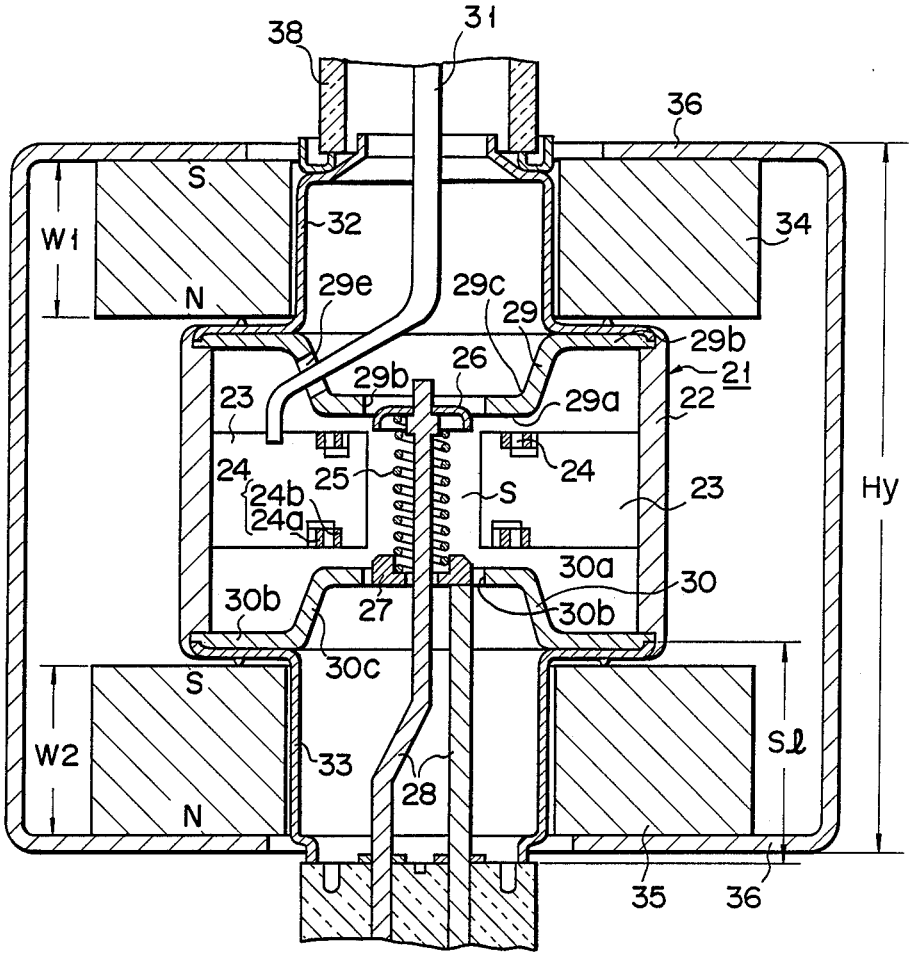
FIG. 4 is a longitudinal sectional view schematically showing a magnetron according to an embodiment of the present invention.
Figure 5:
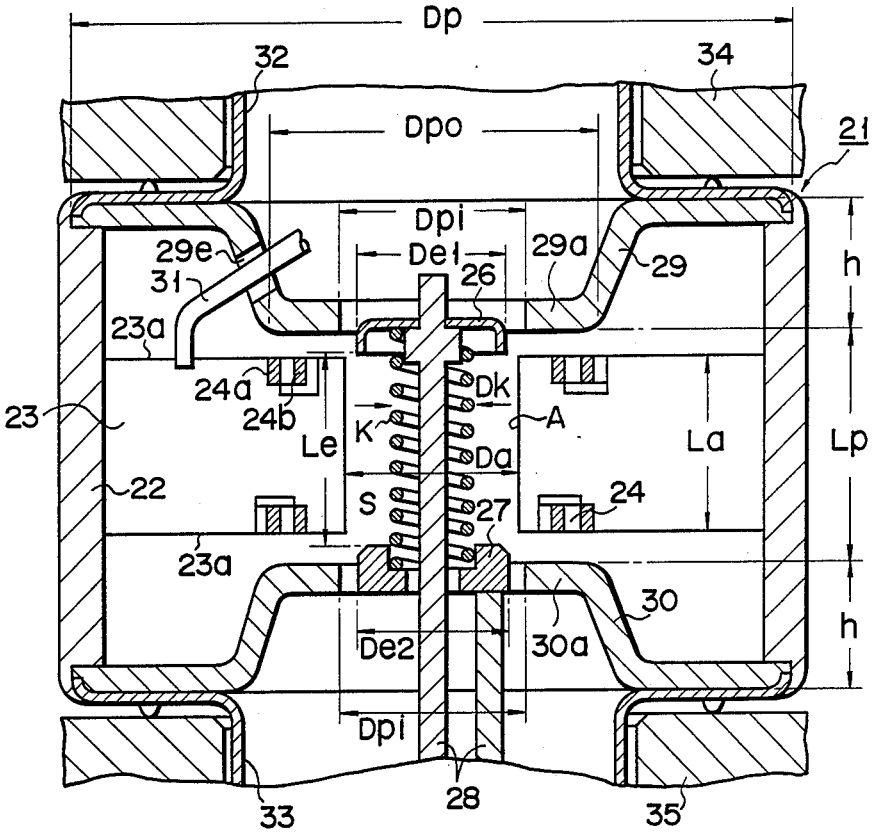
FIG. 5 is an enlarged, partial longitudinal sectional view of the magnetron shown in FIG. 4.

FIGS. 4 and 5 show a magnetron having an oscillation frequency of 2450 MHz range, output power of 600-W type and ten vanes according to an embodiment of the present invention. As is well known, in the magnetron, coil-like filament cathode 25 is arranged in anode cylinder 22 made of copper along its axis, and one end of each of ten anode vanes 23 which are radially arranged is fixed to the inner surface of cylinder 22. Ring-shaped end shields 26 and 27 are provided to two ends of filament cathode 25. End shields 26 and 27 are fixed to cathode support member 28. Thus, filament cathode 25 is supported by cathode support member 28 extending from the outside of anode cylinder 22, and is in electrical contact therewith. Radially arranged anode vanes 23 are alternately and electrically connected by strap rings 24 which are fitted in notches of vanes 23. Iron pole pieces 29 and 30 and thin iron cylindrical chambers 32 and 33 are fitted in openings of anode cylinder 22. Cylindrical chambers 32 and 33 project outside anode cylinder 22, and pole pieces 29 and 30 extend inside anode cylinder 22. As shown in the sectional view of FIG. 4, pole pieces 29 and 30 have a dish shape. Holes for receiving end shields 26 and 27 are formed in flat inner disk sections 29*a* and 30*a* of pole pieces 29 and 30, and outer flat flange sections 29*b* and 30*b* are fitted in the openings of anode cylinder 22. Flat inner disk sections 29*a* and 30*a* and flange sections 29*b* and 30*b* are integrally coupled by corresponding coupling sections 29*c* and 30*c* extending from flange sections 29*b* and 30*b* to that inner disk sections 29*a* and 30*a*, respectively. Flat inner disk sections 29*a* and 30*a* of iron pole pieces 29 and 30 oppose each other to define an interaction space S to which a magnetic field is applied, and to which an electric field between filament cathode 25 and inner ends of anode vanes 23 is applied. One end of output antenna lead 31 is connected to one of anode vanes 23. Antenna lead 31 extends, through a hole 2*e* formed in coupling section 29*c* of pole piece 29, inside ceramic cylinder 38 serving as an antenna output section which is hermetically sealed by cylindrical chamber 32. Ring-shaped permanent magnets 34 and 35 formed of strontium-based ferrite are respectively arranged around cylindrical chambers 32 and 33 and on flange sections 29*b* and 30*b* of pole pieces 29 and 30. Permanent magnets 34 and 35 are magnetically coupled to iron yoke 36 arranged outside anode cylinder 22.

In the magnetron of the present invention, flat disk sections 29*a* and 30*a* of pole pieces 29 and 30 facing interaction space S and side surfaces 23*a* of anode vanes 23 have relatively large diameters, as will be described later. For example, in the 2450-MHz range, 600-W magnetron shown in FIGS. 4 and 5, assuming that electron emission surface K of coil-like filament cathode 25 is substantially cylindrical, outer diameter Dk of anode 25 is 3.9 mm; diameter Da of an envelope defines by connecting anode vane inner end faces A, 9.08 mm; vane width La, 9.5 mm; outer diameter De1 of end seal 26, 7.2 mm; outer diameter De2 of end seal 27, 8.2 mm; distance Le between two end seals, 10.4 mm; diameter Dpi of the central through hole of section 29*a* or 30*a* of the pole piece, 9.4 mm; outer diameter Dpo of section 29*a* or 30*a*, 18 mm; distance Lp between the flat disk sections of the pole pieces, 12.7 mm; outer diameter Dp of the pole piece, 37.5 mm; height h of the pole piece, 7.0 mm; the thickness of the pole piece, 1.6 mm; inner and outer diameters of ring-shaped ferrite permanent magnet 34 or 35, 20 mm and 54 mm; thickness W1 of one magnet 34, 12.6 mm; and thickness W2 of the other magnet 35, 13.5 mm. The thickness of iron metal chambers 32 and 33 is 0.5 mm. Metal chambers 32 and 33 are respectively inserted in magnets 34 and 35 to have a gap of about 0.5 mm or less between themselves and the inner surfaces of the magnets. The thickness of iron yoke 36 is 1.4, and is assembled to have a box shape. Copper strap rings 24 include large-diameter strap rings 24*a* having an outer diameter of 17.8 mm, and small-diameter strap rings 24*b* having an inner diameter of 12.9 mm. Diameter Dpi of the central through holes of pole pieces 29 and 30 is set to be substantially equal to diameter Da of the envelope contacting the 10 vanes inner ends, that is, equal to or slightly larger or less (e.g., about 5%) than diameter Da of the envelope contacting the 10 vane inner ends. Outer diameter Dpo of flat disk sections 29*a* and 30*a* of pole pieces 29 and 30 is set to be twice envelope inner diameter Da of the anode vane inner ends. Therefore, outer diameter Dpo of disk sections 29*a* and 30*a* of pole pieces 29 and 30 is set to be equal to or slightly larger than the outer diameter of large-diameter strap ring 24*a*. The antenna lead 31 is coupled to the predetermined anode vane 23 to which the large-diameter strap ring 24*a* is connected at a output side.

Figure 1:
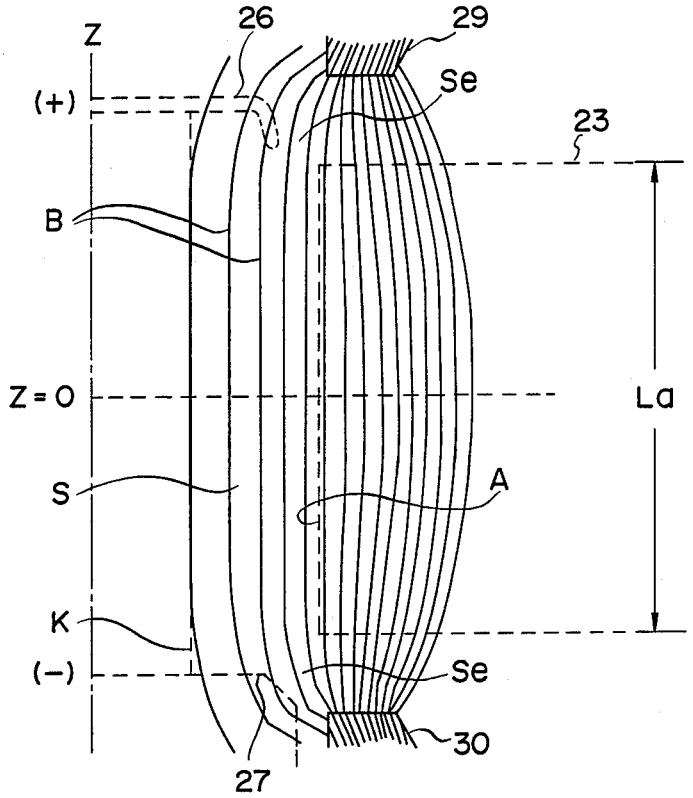
FIG. 1 (PRIOR ART)
FIG. 1 is a view schematically showing a magnetic flux distribution in an interaction space and a surrounding space in a conventional magnetron.
Figure 2:
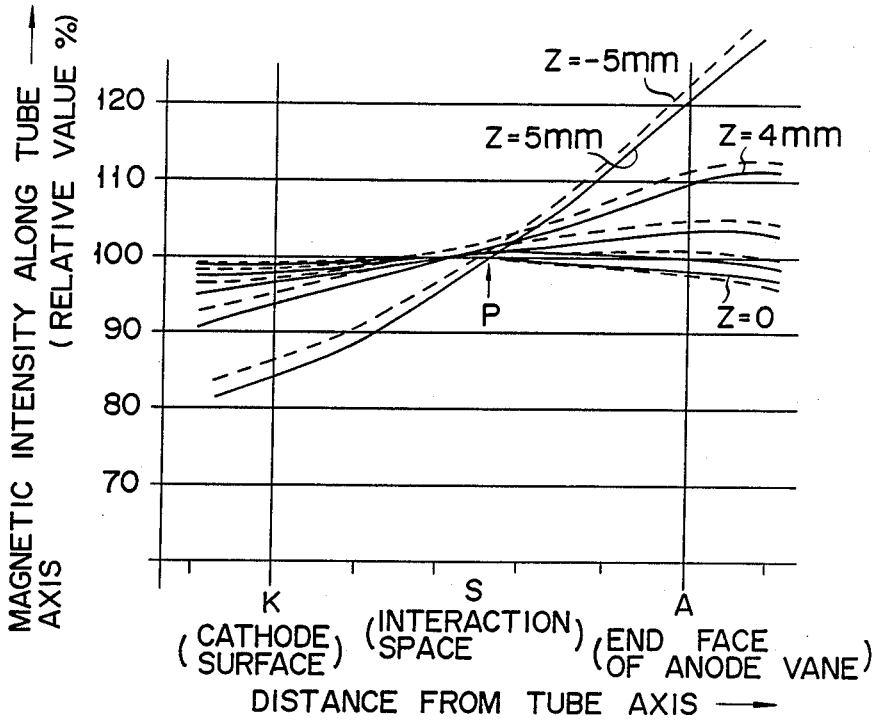
FIG. 2 (PRIOR ART)
FIG. 2 is a graph showing a magnetic field intensity distribution in an interaction space of a magnetron having the magnetic flux distribution shown in FIG. 1.
Figure 6:
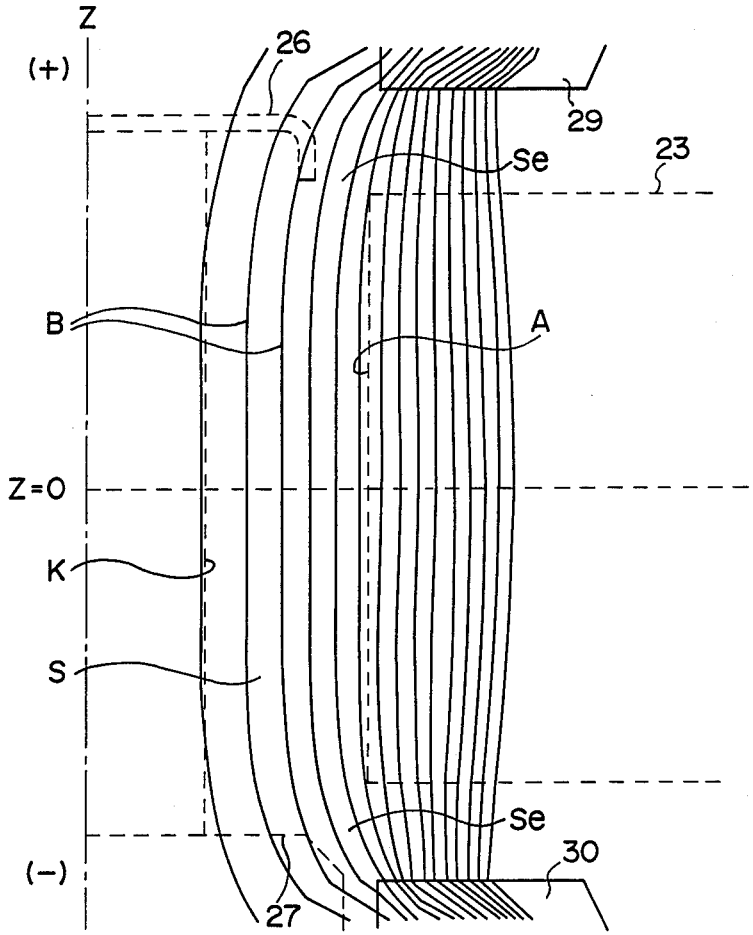
FIG. 6 is a view schematically showing a magnetic flux distribution in an interaction space and a surrounding space in the magnetron shown in FIG. 5.
Figure 7:
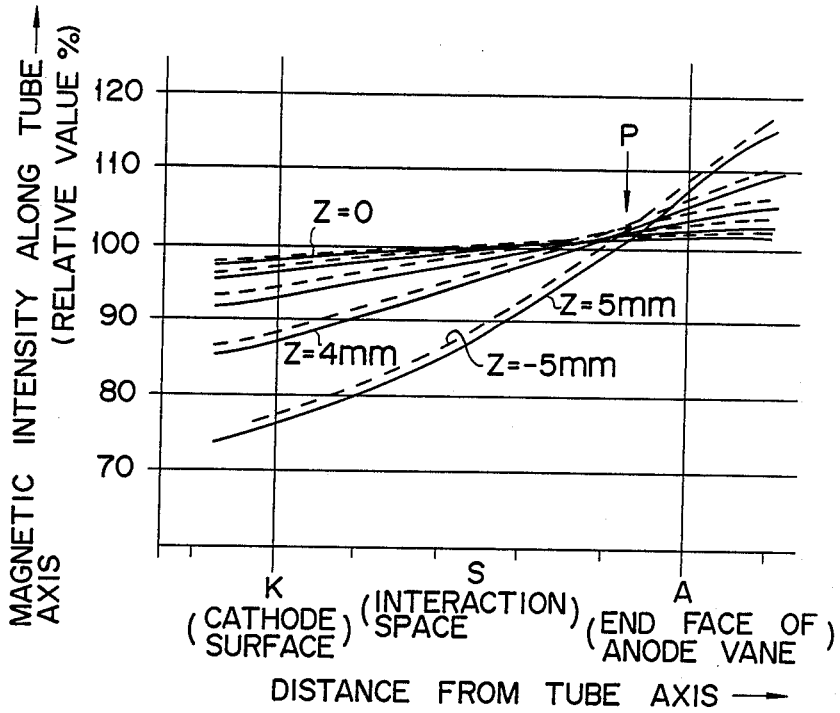
FIG. 7 is a graph showing a magnetic field intensity distribution in the interaction space of the magnetron having the magnetic flux distribution shown in FIG. 6.

The magnetron with the above structure has a magnetic flux distribution shown in FIG. 6 near interaction space S. More specifically, since the outer diameter of disk section 29*a* (or 30*a*) of pole piece 29 (or 30) is sufficiently large, a magnetic flux distribution relatively parallel to the tube axis can be formed in a space region in which the end portions of vanes 23 are arranged. In the magnetron shown in FIGS. 4 and 5, paying attention to a magnetic field intensity of a vector component along the tube axis in a magnetic field in interaction space S, its intensity distribution is examined. As a result, the magnetron has a distribution shown in FIG. 7. FIG. 7 shows a relative magnetic field intensity in an interaction space between cathode surface K and anode inner end face A when an average magnesurface K to anode inner end face A at the central portion (Z=0) of interaction space S is given by 100%, and distances along the tube axis from the central portion to respective points (Z=0, Z=±1 mm, Z=±2 mm, Z=±3 mm, Z=±4 mm, and Z=±5 mm) are used as variables. The axial magnetic field intensity distribution is obtained by measuring the intensities of magnetic field components parallel to the tube axis at respective points by a Gauss meter using a Hall element as a detector. As can be seen from FIG. 7, since pole pieces 29 and 30 having flat disk sections 29*a* and 30*a* are arranged in the magnetron, point P exhibiting a most uniform intensity in the entire axial range of the interaction space appears near anode vain inner end face A. As shown in FIG. 7, a magnetic field difference at anode surface K becomes larger than that in the conventional magnetron as is apparent from the comparison with FIG. 2. However, the magnetic field difference at vane inner end faces A is smaller than that in the conventional magnetron and is reduced to about 7%.

Figure 3:
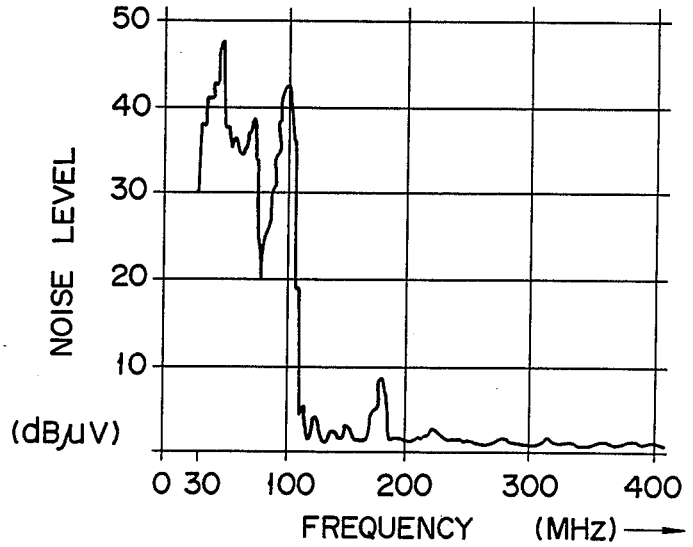
FIG. 3 (PRIOR ART)
FIG. 3 is a graph showing noise characteristics of the magnetron having the magnetic flux distribution shown in FIG. 1.
Figure 8:
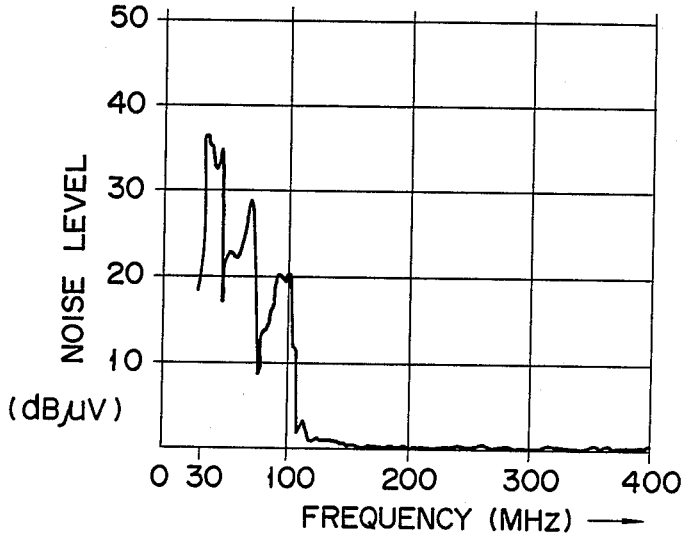
FIG. 8 is a graph showing noise characteristics of the magnetron having the magnetic flux distribution shown in FIG. 6.

In the magnetron of this embodiment, noise leakage to the input side can be improved as shown in FIG. 8. More specifically, in the magnetron of this embodiment, a line noise level of a 100-MHz range component is about 21 dBμV, and is reduced to half that of the conventional magnetron shown in FIG. 3. The entire noise components in the range of 30 to 150 MHz can be greatly reduced. This can be explained as follows. That is, since the axial magnetic field intensity near the anode vane inner end faces is almost uniformed over the entire range along the axial direction, the rotational speeds of electron cloud is substantially uniform over the entire range in the axial direction of the vanes. Thus, a frequency difference in high frequency electric fields induced in a resonance cavity including the vanes is small, and the influence of the frequency difference component is thus small. In this manner, in the magnetron of this embodiment, the line noise level of a generation source itself can be suppressed.

Figure 9:
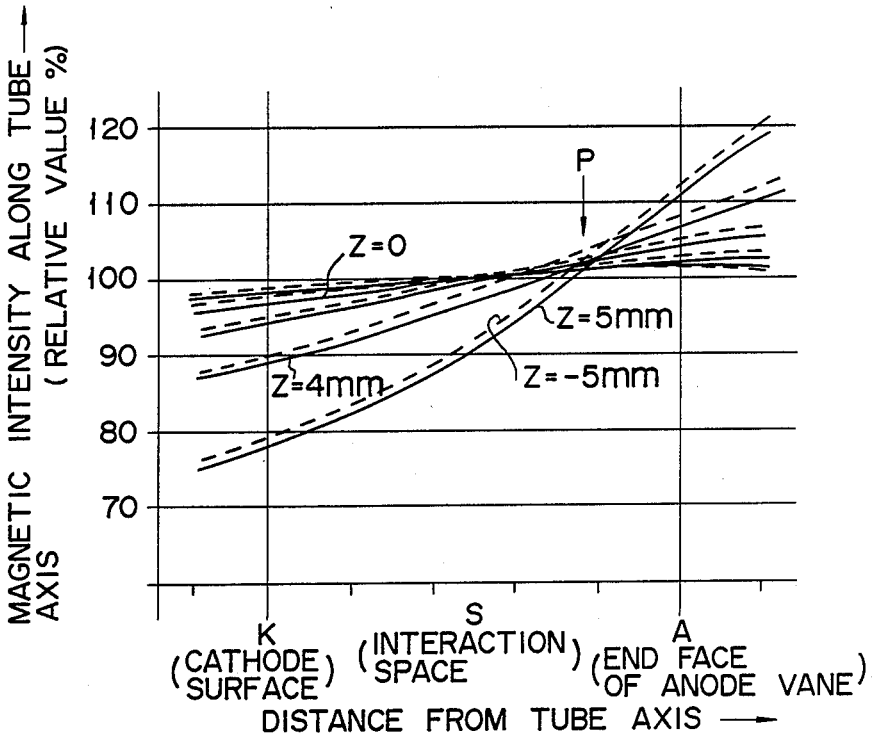
FIGS. 9 and 10 are graphs respectively showing a magnetic field intensity distribution and noise characteristics of a magnetron according to another embodiment of the present invention.

FIG. 9 shows a magnetic field intensity distribution in a magnetron wherein outer diameter Dpo of flat disk sections 29*a* and 30*a* of a pair of pole pieces 29 and 30 is set to be 16 mm. More specifically, outer diameter Dpo of disk section 29*a* or 30*a* of pole piece 29 or 30 is set to be about 177% of diameter Da of an envelope contacting the vane inner ends. The other dimensions and shapes of other sections in the magnetron are set to be the values described with reference to FIGS. 4 and 5.

Figure 10:
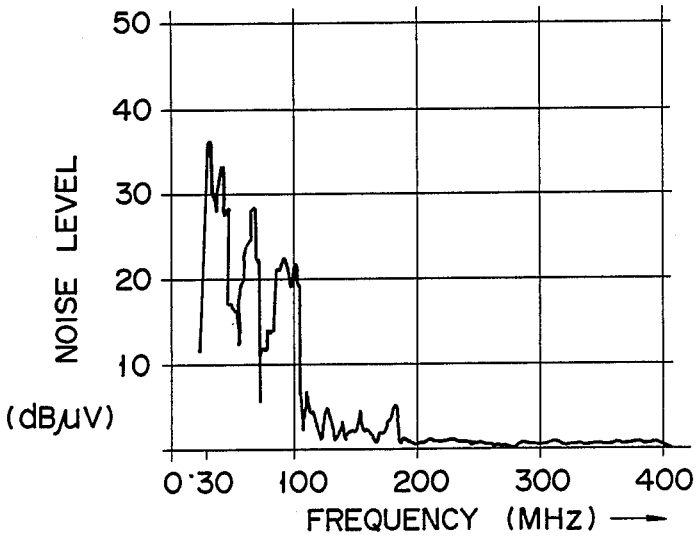

According to this embodiment, a magnetic field intensity difference in the axial direction at the position of anode vane inner end face A is about 11%, and as shown in FIG. 10, a noise level of a 100-MHz range component is about 22 dBμV. It was found that in the magnetron wherein outer diameter Dpo of disk section 29*a* or 30*a* of pole piece 29 or 30 is set to be about 177% of diameter Da of the envelope contacting the vane inner ends, a low-frequency line noise component of the magnetron can be sufficiently suppressed by a line generation source.

Figure 11:
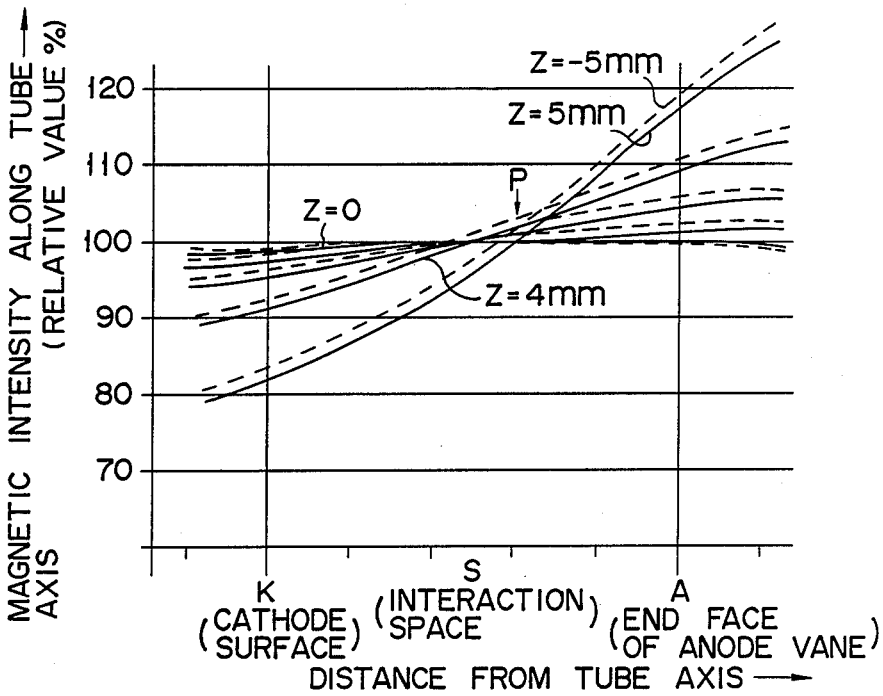
FIGS. 11 and 12 are graphs showing a magnetic field intensity distribution and noise characteristics of a comparative example.
Figure 12:
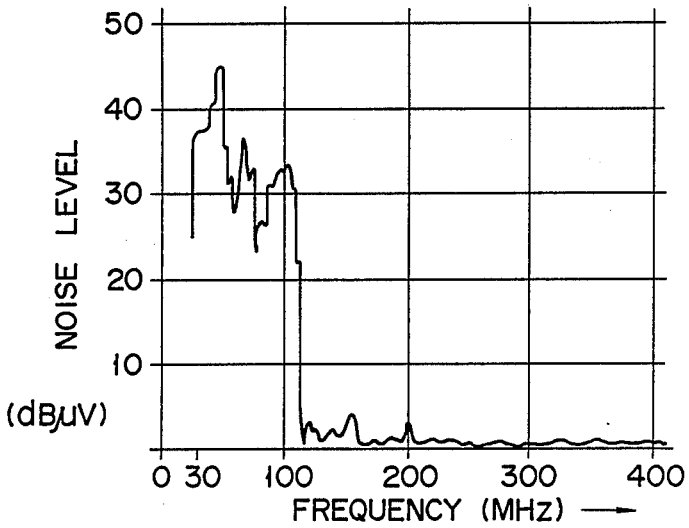

Similarly, a magnetic field intensity distribution shown in FIG. 11 could be obtained in a magnetron wherein outer diameter Dpo of disk section 29*a* or 30*a* of pole piece 29 or 30 was set to be about 155% of diameter Da of an envelope contacting the vane inner ends, i.e., 14 mm. As shown in FIG. 11, the axial magnetic field difference at the vane inner end face position was about 17%, and as shown in FIG. 12, a 100-MHz range noise component had a noise level of about 33 dBμV.

Similarly, in a magnetron wherein outer diameter Dpo of disk section 29*a* or 30*a* of pole piece 29 or 30 was set to be about 132% of vane inner end face diameter Da, i.e., 12 mm, the axial magnetic field intensity difference was about 22%, and the noise level reached about 42 dBμV. That is, the magnetron of this type has substantially the same characteristics as those of a conventional magnetron.

Figure 13:
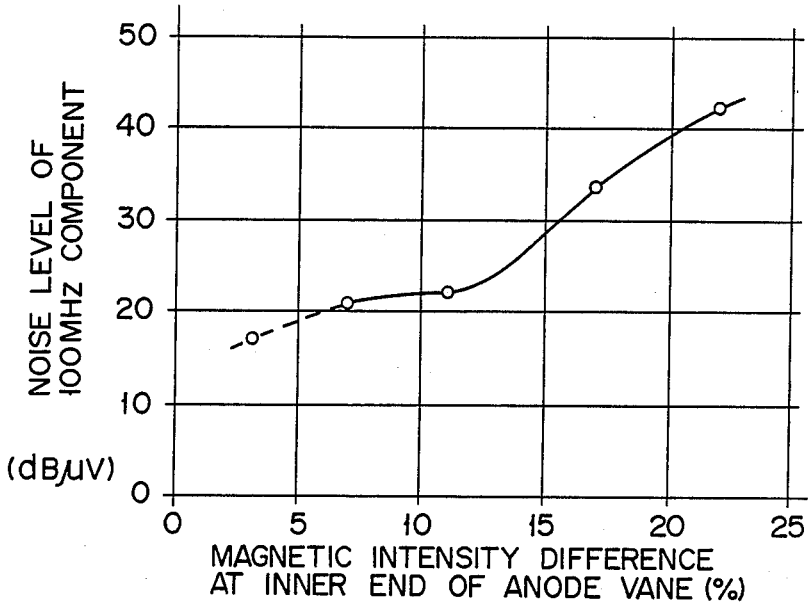
FIG. 13 is a graph showing the relationship between a magnetic field intensity and a noise level.

To summarize the above results, as shown in FIG. 13, it was found that the larger the axial magnetic field difference (difference in relative ratio %) at the position of the vane inner end face becomes, the higher the level of a relatively low-frequency noise component, e.g., a 100-MHz component becomes. From the above finding, it is demonstrated that a line noise level of about 30 dBμV or less that can be regarded as an effect of improvement can be obtained from a structure having an axial magnetic field intensity difference at the vane inner end faces of about 15% or less.

Figure 14:
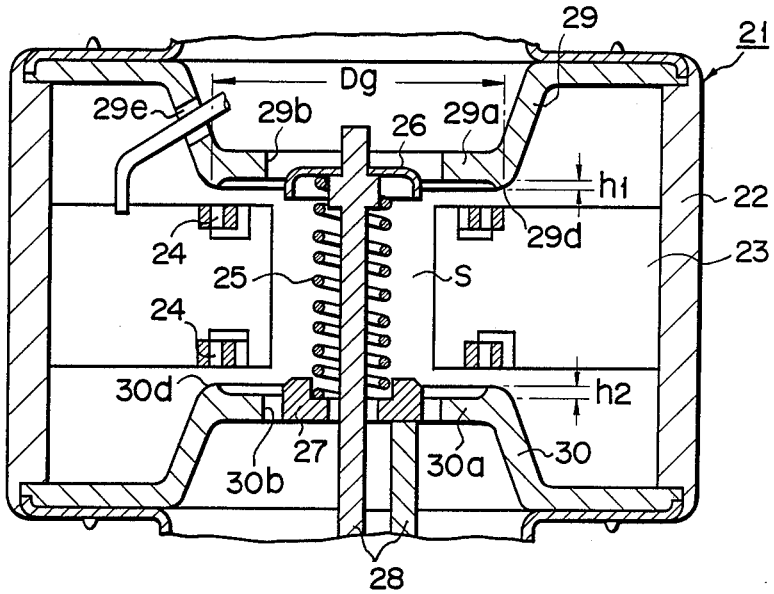
FIG. 14 is a longitudinal sectional view schematically showing a magnetron according to a modification of the present invention.

In a magnetron according to a modification of the present invention shown in FIG. 14, circular projections 29*d* and 30*d* are formed on portions near outer peripheral edges of opposite surfaces of disk sections 29*a* and 30*a* of pole pieces 29 and 30. Heights h1 and h2 of projections 29*d* and 30*d* are 0.5 mm. Diameter Dg of circular projection 29*d* or 30*d* is set to be 17 mm. It was found that in the magnetron of this structure, an axial magnetic field intensity distribution at the vane inner end face position can be improved better than that shown in FIG. 7, and a magnetic field intensity difference can be suppressed to only 3%. It was also found that in this magnetron, a noise level of a 100-MHz range component can be suppressed to about 17 dBμV and can be greatly improved. Note that heights h1 and h2 of projections 29*d* and 30*d* are preferably set to fall within the range of 0.3 to 0.7 mm in practical applications.

Figure 15A:
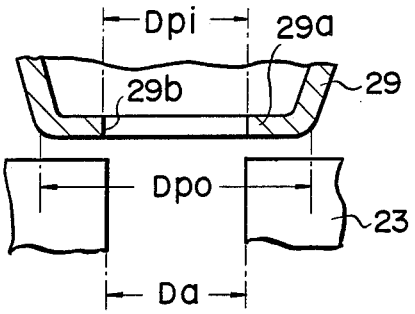
FIGS. 15A and 15B are enlarged sectional views showing pole pieces respectively shown in FIGS. 5 and 14.
Figure 15B:
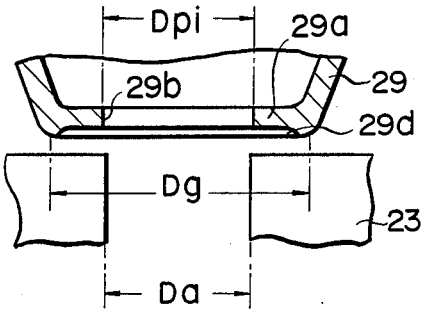
Figure 16:
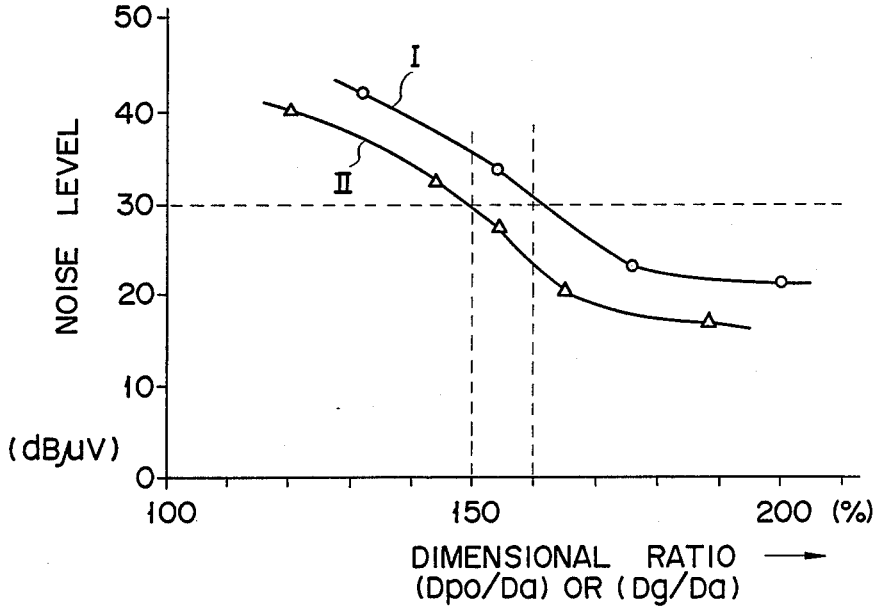
FIG. 16 is a graph showing the relationship between a noise level and a size ratio of flat surface outer diameter Dpo or projection diameter Dg of the pole piece to diameter Da of an envelope contacting the inner ends of anode vanes 23.

It was confirmed that when diameter Dg of circular projections 29*d* and 30*d* formed on the opposing surfaces of disk sections 29 and 30*a* of pole pieces 29 and 30 is changed variously, the magnetic field intensity distribution at the vane inner end face position can be changed, and hence, the line noise level is also changed. More specifically, comparison data associated with a magnetron incorporating pole pieces having substantially perfectly flat surfaces as shown in FIG. 15A and a magnetron incorporating pole pieces having projections as shown in FIG. 15B are obtained, as shown in FIG. 16. Referring to FIG. 16, a ratio of flat surface outer diameter Dpo or projection diameter Dg of the pole piece to diameter Da of an envelope contacting the inner ends of anode vanes is plotted along the abscissa, and a 100-MHz line noise component level is plotted along the ordinate. Curve I represents characteristics of the magnetron incorporating the pole pieces having only the flat surfaces, and curve II represents characteristics of the magnetron incorporating the pole pieces having the projections. As can be seen from curve I shown in FIG. 16, in the magnetron incorporating the pole pieces having only the flat surfaces, in order to suppress a line noise level below 30 dBμV determined based on the CISPR standards, a ratio of flat surface outer diameter Dpo to diameter Da of the envelope contacting the vane inner ends must be set to be about 160% or more. As can be seen from curve II shown in FIG. 16, in the magnetron incorporating the pole pieces having projections, in order to suppress a line noise level below 30 dBμV determined based on the CISPR standards, diameter Dg of the projection is preferably set to be 150% or more of diameter Da of envelope contacting the vane inner ends.

It was also found that the above data is not much changed even if height h of the pole piece, inner and outer diameters and heights of the permanent magnet, and the like are slightly changed.

According to the magnetron of the embodiment of the present invention, a filter circuit constituted by a combination of a choke coil and a capacitor inserted in a cathode input line, in particular, the capacitance of the capacitor can be reduced. More specifically, in the conventional magnetron, external leakage is suppressed using a capacitor having a relatively large capacitance, e.g., 500 pF and an inductor having about 1μH. However, in the magnetron of the present invention, since the low-frequency noise component itself is not so much generated, the capacitor can be replaced with one having a capacitance of several tens of pF.

According to the magnetron described above, an axial magnetic field strength at an anode vane inner end position in the interaction space can be substantially uniformed over the entire range in the axial direction, i.e., 15% or less, because outer diameter of the flat inner disk sections 29a, 30a is larger than 160% diameter of the envelope contacting inner ends of anode vanes 23. Therefore, a frequency difference of high-frequency electric fields induced in a resonance cavity by electron cloud can be substantially uniform over the entire range in the axial direction of the vanes, and the influence of the difference frequency component is not large, thus suppressing an unnecessary line noise level. Therefore, a magnetron with less unnecessary radiation can be obtained.

A magnetron according to another embodiment of the present invention will now be described with reference to FIG. 17. The same reference numerals in FIG. 17 denote the same portions or parts which have already been described with reference to other drawings, and a detailed description thereof will be omitted.

Figure 17:
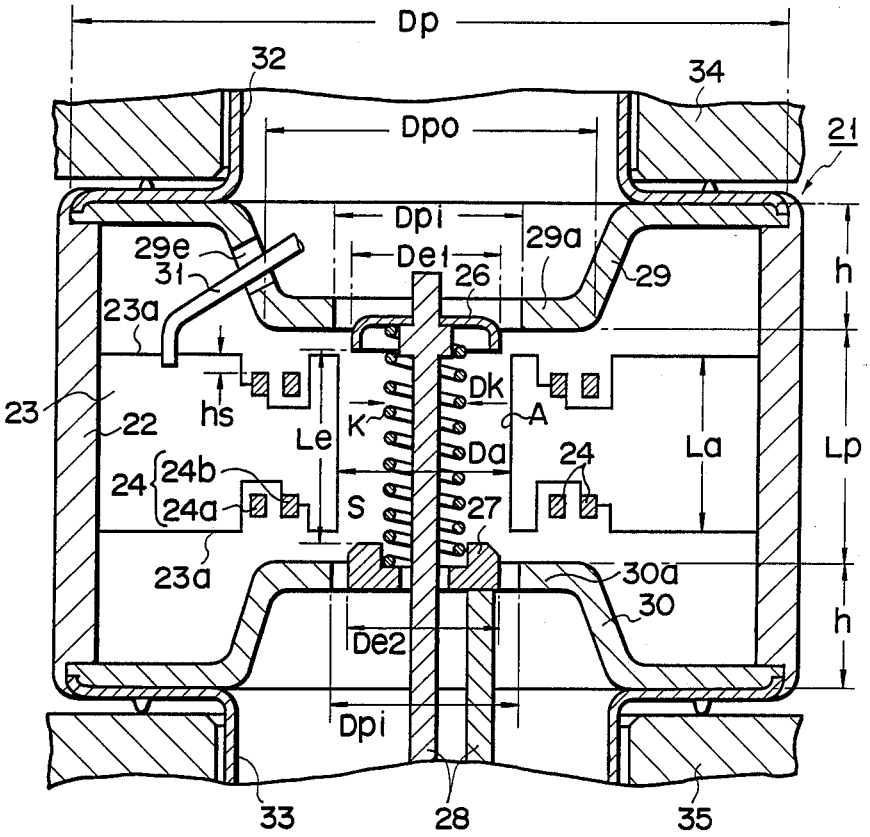
FIG. 17 is a longitudinal sectional view schematically showing a magnetron according to still another embodiment of the present invention.

Magnetron shown in FIG. 17 has an oscillation frequency of 2450 MHz and output power of 600-W, wherein electron emission surface K of coil-like filament cathode 25 is substantially cylindrical, outer diameter Dk of anode 25 is 3.9 mm; diameter Da of an envelope defined by connecting anode vane inner end faces A, 9.06 mm; vane width La, 8.5 mm; outer diameter De1 of end seal 26, 7.2 mm; outer diameter De2 of end seal 27, 8.2 mm; distance Le between two end seals, 9.5 mm; diameter Dpi of the central through hole of section 29a or 30a of the pole piece, 9.4 mm; outer diameter Dpo of section 29a or 30a, 18 mm; distance Lp between the flat disk sections of the pole pieces, 11.7 mm; outer diameter Dp of the pole piece, 37.5 mm; height h of the pole piece, 7.0 mm; the thickness of the pole piece, 1.6 mm; inner and outer diameters of ring-shaped ferrite permanent magnet 34 or 35, 20 mm and 54 mm; thickness W1 of one magnet 34, 12.6 mm; and thickness W2 of the other magnet 35, 9.0 mm. The thickness of iron metal chambers 32 and 33 is 0.5 mm. Metal chambers 32 and 33 are respectively inserted in magnets 34 and 35 to have a gap of about 0.5 mm or less between themselves and the inner surfaces of the magnets. The thickness of iron yoke 36 is 1.4 mm, and is assembled to have a box shape. Copper strap rings 24 include large-diameter strap rings 24a having an outer diameter of 17.8 mm, and small-diameter strap rings 24b having an inner diameter of 12.9 mm. Diameter Dpi of the central through holes of pole pieces 29 and 30 is set to be substantially equal to diameter Da of the envelope contacting the 10 vane inner ends, that is, to be equal to or slightly larger or less (e.g., about 5%) than diameter Da of the envelope contacting the 10 vane inner ends. Outer diameter Dpo of flat disk sections 29a and 30a of pole pieces 29 and 30 is set to be twice envelope inner diameter Da of the anode vane inner ends. Therefore, outer diameter Dpo of disk sections 29a and 30a of pole pieces 29 and 30 is set to be equal to or slightly larger than the outer diameter of large-diameter strap ring 24a.

In the magnetron shown in FIG. 17, unlike in the magnetron shown in FIGS. 4 and 5, the end face of each strap ring 24 does not coincide with side end face 23a of each vane 23, and ring 24 is fitted in a notch of vane 23 to have a gap, e.g., 0.3 to 0.7 mm (size hs) between its end face and side end face 23a of vane 23. Ring 24 is partially buried in vane 23. Axial length Sl (as shown in FIG. 4) of metal chamber 33 at the input side is set to be sufficiently small, i.e., 11 mm while axial length Sl of metal chamber 33 at the input side of the conventional magnetron is set to be 40.4 mm. Table 1 below shows sizes of respective sections of the magnetron of the conventional structure, and the magnetron according to the embodiment of the present invention shown in FIG. 17 for the purpose of comparison.

TABLE 1

| Portion | La | Lp | Le | Sl | W2 | Hy | Unit (mm) hs |
|---|---|---|---|---|---|---|---|
| Prior Art | 9.5 | 12.7 | 10.4 | 20.4 | 13.5 | 58.2 | 0 |
| Embodiment | 8.5 | 11.7 | 9.4 | 13.5 | 9 | 52.0 | 0.3–0.7 |

Figure 18:
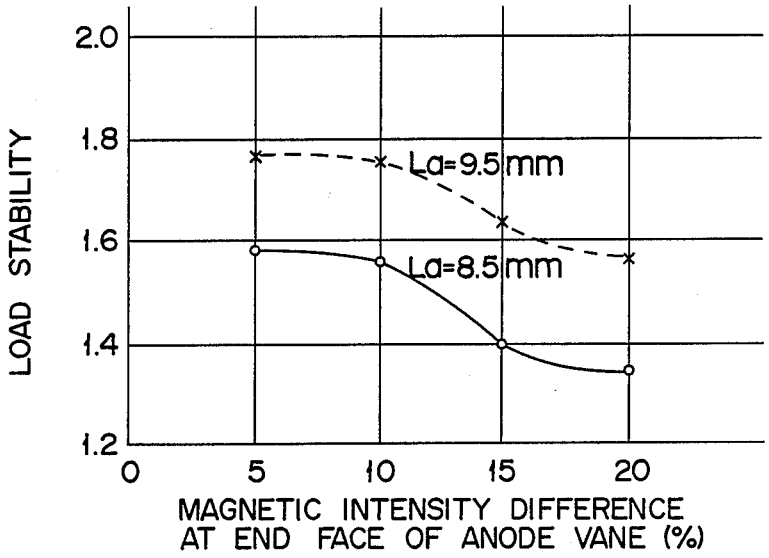
FIG. 18 is a graph showing the relationship between a magnetic field intensity difference and load stability in the magnetron shown in FIG. 17.

FIG. 18 shows a change in load stability of the magnetron with respect to an axial magnetic field difference at the vane inner end faces in magnetrons respectively having vane lengths La of 8.5 mm and 9.5 mm. As can be seen from FIG. 18, in a magnetron having an axial magnetic field intensity difference of 20% at the vane inner end faces, if vane height La is decreased by 1 mm, load stability is degraded from 1.55 A to 1.32 A. However, in a magnetron having an axial magnetic field intensity difference of 10% at the vane inner end faces, i.e., having a pole piece flat surface outer diameter of 16 mm, satisfactory load stability as high as that of a conventional magnetron can be obtained even if La=8.5 mm.

Figure 19:
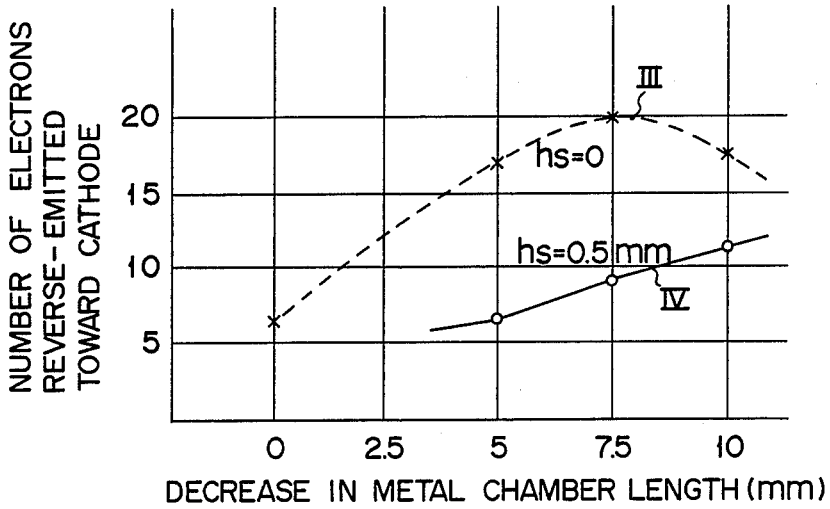
FIG. 19 is a graph showing the relationship between a decrease in metal chamber length and the number of electrons reverse-emitted toward a cathode in a magnetron having a conventional structure and the magnetron shown in FIG. 17.

The relationship between length Se of metal chamber 38 arranged at the input side and the number of electrons reversely emitted toward the cathode was examined, and data shown in FIG. 19 was obtained. As represented by curve III in FIG. 19, in a magnetron having the conventional structure (hs=0 mm), if length Se of the metal chamber is decreased by 10 mm, the number of electrons reversely emitted toward the cathode is increased by 10%, and the cathode temperature is increased to shorten the service life of the magnetron. In contrast to this, in a magnetron wherein gap hs=0.5 mm is formed between the end face of each strap ring 24 and corresponding side end face 23a of vane 23, and strap ring 24 is arranged in the notch of vane 23 to be partially buried in vane 23, the number of electrons reversely emitted toward the cathode is not increased, as represented by curve IV in FIG. 19.

Figure 20:
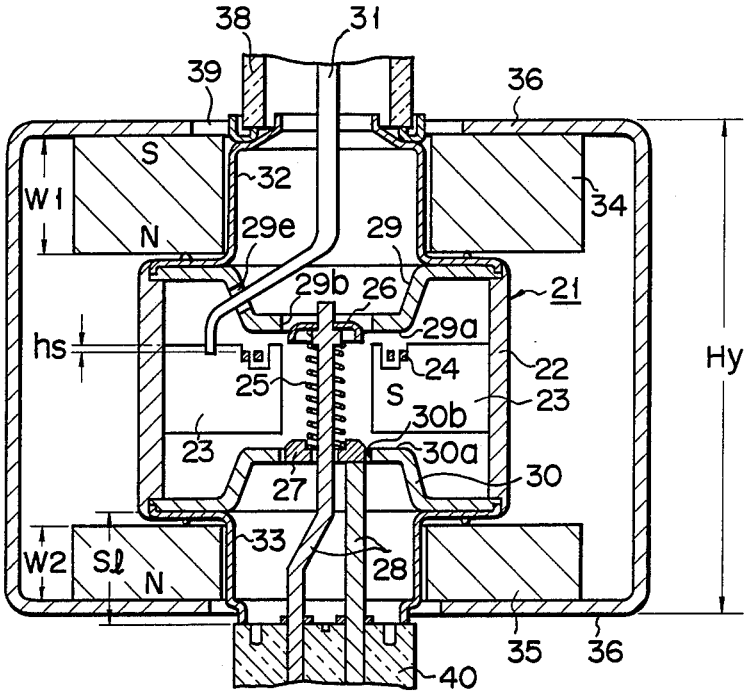
FIG. 20 is a longitudinal sectional view schematically showing a magnetron according to another modification of the present invention.

It was also confirmed that in a magnetron wherein a notch is formed only in the end face side of vane 23 to which output antenna lead 31 is connected, and each strap ring 24 is arranged in this notch, as shown in FIG. 20, when gap hs is formed between the end face of each strap ring 24 and corresponding side end face 23*a* of vane 23, and each strap ring 24 is arranged in the corresponding notch of vane 23 to be partially buried in vane 23, the same effect as described above can be obtained. Similarly, in a magnetron wherein strap ring 24 is provided to only the input stem side of vane 23, when gap hs is formed between the end face of each strap ring 24 and corresponding side end face 23*a* of vane 23, the same effect as described above can be obtained.

Figure 21:
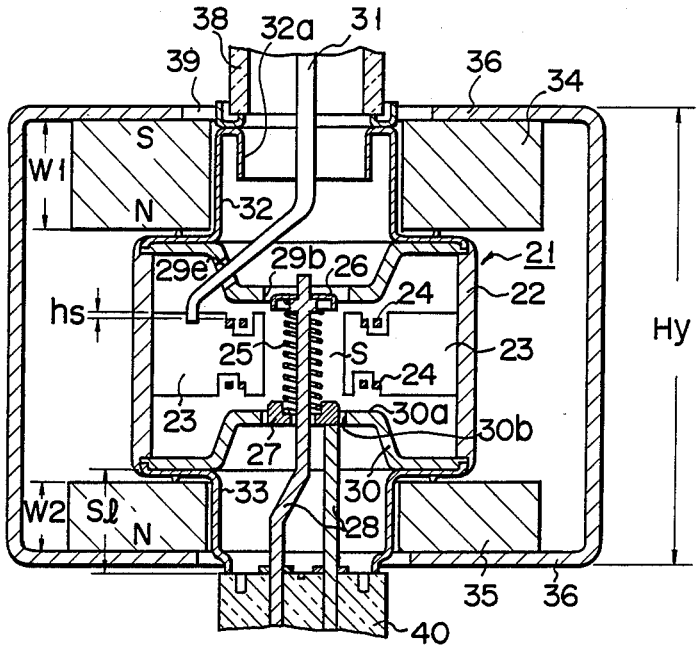
FIG. 21 is a longitudinal sectional view schematically showing a magnetron according to still another modification of the present invention.
Figure 22:
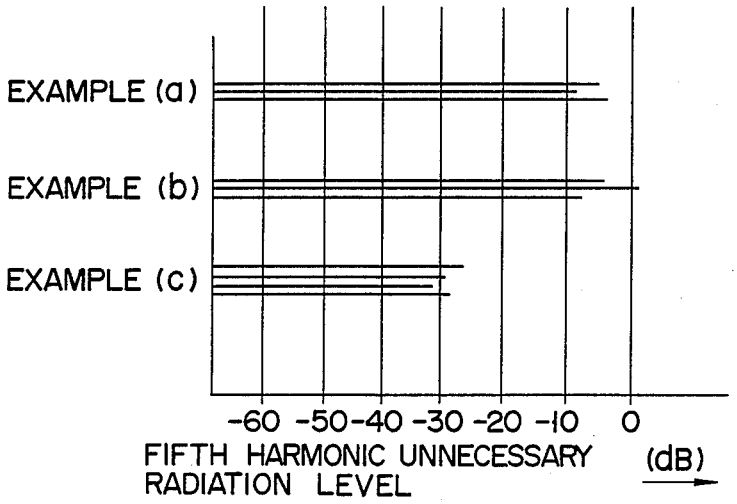
FIG. 22 is a graph showing an unnecessary radiation level of a fifth harmonic in a conventional magnetron and the magnetron shown in FIG. 21.

In an embodiment of a magnetron shown in FIG. 21, disk sections 29*a* and 30*a* of pole pieces 29 and 30 have sufficient sizes, gap hs is formed between the end face of each strap ring 24 and corresponding side end face 23*a* of vane 23, and ¼-wavelength choke cylinder 32*a* for suppressing unnecessary radiation is arranged inside output-side metal chamber 32. Output antenna lead 31 is coupled to a vane, to which large-diameter strap ring 24*a* is welded at output side. With this structure, it was found that, as shown in example (c) in FIG. 22, an unnecessary radiation level of a harmonic component such as the 5th harmonic which is included in a microwave radiating from output antenna, can be improved by about 20 dB as compared to a conventional magnetron having an unnecessary radiation level shown in example (a) in FIG. 22. Example (b) in FIG. 22 shows an unnecessary radiation level of a harmonic component such as the 5th harmonic in a conventional magnetron having only a choke structure as shown in FIG. 21.

As described above, in a magnetron wherein gap hs is formed between the end face of each strap ring 24 and corresponding side end face 23*a* of vane 23, each strap ring 24 is partially buried therein, pole piece distance Lp can be decreased by about 1 mm, and a magnetic efficiency can be improved, so that thickness W2 of the magnet at the input stem side can be shortened from 13.5 mm to 9 mm. In addition, the length of the input-side metal chamber can also be shortened. As a result, the axial length of the magnetron, i.e., the height can be decreased by about 15 mm.

Figure 23:
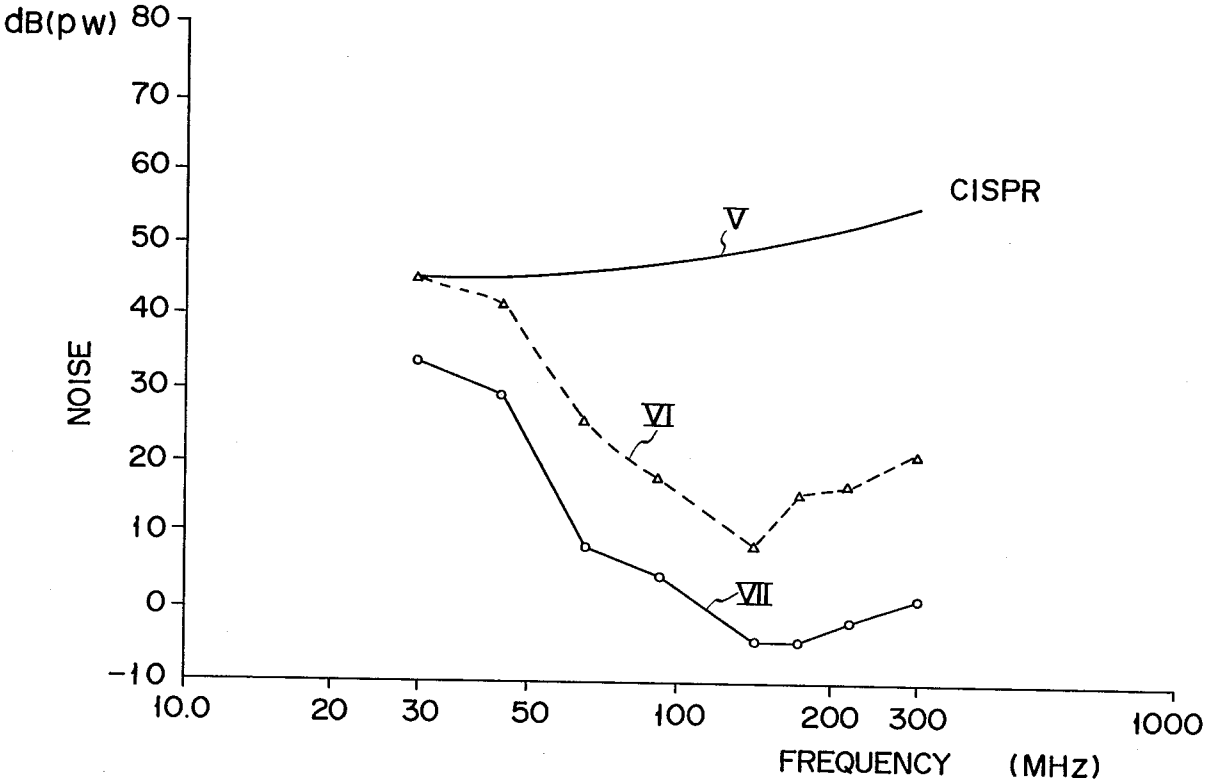
FIG. 23 is a graph showing a noise level with respect to frequencies of a conventional magnetron and a magnetron of the present invention.

FIG. 23 shows a noise level with respect to frequencies of a conventional magnetron represented by curve VI and a magnetron represented by curve VII for the sake of comparison with the CISPR standards represented by curve V. The conventional magnetron indicated by curve VI has a choke structure, and its noise level of 30 MHz can be narrowly suppressed to satisfy the CISPR standards indicated by curve V by means of the choke structure. In contrast to this, in the magnetron of the present invention, indicated by curve VII, its noise level of various frequency bands can be decreased at 10 dB in comparison with that of conventional one and can fall within that of the CISPR standards indicated by curve V.

According to the present invention as described above, the magnetic field in the interaction space can be uniformed, and electromagnetic coupling between the pole pieces and the strap rings can be eliminated. Therefore, if the axial length of the vanes is shortened, load stability is not degraded. If the length of the input stem is shortened, the number of electrons reversely emitted toward the cathode is not increased. In particular, electrostatic and magnetic field distributions in the interaction space can be improved, generation of a relatively low-frequency noise component can be suppressed, and a compact, lightweight, reliable magnetron for a microwave oven can be obtained.

What is claimed is:

1. A magnet on comprising:

an anode cylinder having a tube axis, two openings, and an inner surface;

a cathode, arranged along said tube axis, for emitting electrons from its surface;

a cathode support member, extending along the tube axis, for supplying a current to said cathode;

a pair of end shields, electrically coupled to said cathode support member, for supporting said cathode arranged therebetween;

a plurality of a anode vanes, radially arranged around said cathode, inner ends of said plurality of anode vanes facing said cathode so that a gape between said inner ends and said cathode defines an interaction space and a resonance cavity exists between said cathode and said anode cylinder, outer ends of said plurality of anode vanes being fixed to said inner surface of said anode cylinder so that said inner ends define an imaginary envelope having a predetermined diameter, and end portions between said inner and outer ends containing notches;

a pair of pole pieces having a substantially dish shape for supplying magnetic flux to said interaction space that has a magnetic component directed along the tube axis in said imaginary envelope that has magnetic field difference of not more than 15% along said tube axis, each of said pole pieces arranged opposite each other and including:

a flange portion mounted on one of said openings of said anode cylinder, a flat disk section, arranged adjacent to said anode vanes and having a predetermined outer diameter larger than 160% of the diameter of the imaginary envelope, a through hole disposed in said flat disk section that has a diameter substantially equal to that of the imaginary envelope, and in which one of said end shields is arranged, and a coupling section for coupling said flange and disk portions;

a pair of large- and small-diameter strap rings for alternately connecting said anode vanes that are arranged in said notches of said anode vanes and have end portions facing said pole pieces so that a gap exists between said end portions of said anode vanes and said end portions of said strap rings;

a pair of permanent magnets for generating the magnetic flux supplied to said pair of pole pieces;

an antenna lead, electrically coupled to the resonance cavity, for guiding microwaves generated in the resonance cavity; and a yoke for magnetically coupling said pair of permanent magnets.

2. A magnetron according to claim 1, wherein said antenna lead and said large-diameter strap ring are connected to the same end portion of the anode vane.

3. A magnetron comprising:

an anode cylinder having a tube axis, two openings and an inner surface;

a cathode, arranged along said tube axis, for emitting electrons from its surface;

a cathode support member extending along the tube axis for supplying a current to said cathode;

a pair of end shields, electrically coupled to said support member, for supporting said cathode arranged therebetween;

a plurality of a anode vanes, radially arranged around said cathode, inner ends of said plurality of anode vanes facing said cathode so that a gap between said inner ends and said cathode defines an interaction space and a resonance cavity exists between said cathode and said anode cylinder, outer ends of said plurality of anode vanes being fixed to said inner surface of said anode cylinder so that said inner ends define an imaginary envelope having a predetermined diameter, and end portions between said inner and outer ends containing notches;

a pair of pole pieces having a substantially dish shape, for supplying magnetic flux to said interaction space that has a magnetic component directed along the tube axis in said imaginary envelope that has a magnetic field intensity difference of not more than 15% along said tube axis, each of said pole pieces arranged opposite each other and including:

a flange portion mounted on the corresponding opening of said anode cylinder, a flat disk section, arranged adjacent to said anode vanes, having a predetermined outer diameter that is larger than 150% of the imaginary envelop and a surface facing said anode vanes, a through hole in said flat disk section that has a diameter substantially equal to that of the imaginary envelope and in which one of said end shields is arranged, a coupling section for coupling said flange and disk portions, and a substantially circular projection disposed on the outer diameter of said flat disk section;

a pair of large- and small-diameter strap rings for alternately connecting said anode vanes that are arranged in said notches of said anode vanes and have end portions facing said pole pieces so that a gap exists between said end portions of said anode vanes and said end portions of said strap rings;

a pair of permanent magnets for generating the magnetic flux supplied to said pair of pole pieces;

an antenna lead, electrically coupled to the resonance cavity, for guiding microwaves generated in the resonance cavity; and a yoke for magnetically coupling said pair of permanent magnets.

4. A magnetron according to claim 3, wherein said antenna lead and said large-diameter strap ring are connected to the same end portion of the anode vane.

* * * * *